United States Patent [19]

Roach

[11] 4,322,050

[45] Mar. 30, 1982

[54] ADJUSTABLE BRACKET FOR A DECORATOR ROD

[76] Inventor: Stanley G. Roach, 3819 Southwest 14th St., Des Moines, Iowa 50309

[21] Appl. No.: 114,069

[22] Filed: Jan. 21, 1980

[51] Int. Cl.[3] ..... A47B 96/06; A47G 55/00

[52] U.S. Cl. ..... 248/222.2; 248/265

[58] Field of Search ..... 248/258, 257, 270, 73, 248/221.1, 223.3, 222.12; 16/94 R, 94 D

[56] References Cited

U.S. PATENT DOCUMENTS 2,218,894 10/1970 Schlosser ..... 248/73
3,704,851 12/1972 Cormier ..... 248/257 X
4,140,294 2/1979 Zwarts ..... 248/270 X
4,167,261 9/1979 Bartels ..... 248/258 X

FOREIGN PATENT DOCUMENTS 702073 1/1965 Canada ..... 248/265

*Primary Examiner*—Ronald Feldbaum
*Attorney, Agent, or Firm*—Henderson & Sturm

[57] ABSTRACT

This invention relates to adjustable support brackets in general, and more specifically to an adjustable curtain rod support for use on a window frame, casement or the like, which has an unique slot and groove arrangement on the bracket which cooperated with multiple tangs on the movable support arm to provide a rigid support surface for the curtain rod.

4 Claims, 3 Drawing Figures

ADJUSTABLE BRACKET FOR A DECORATOR ROD

BACKGROUND OF THE INVENTION

There have been many attempts in the past to devise an adjustable curtain rod support which is easy to install, vertically and laterally adjustable, and which will rigidly support a curtain, traverse or decorator rod and the material which is suspended therefrom.

Examples of some of the prior art devices may be found by reference to the following U.S. Pat. Nos.: 3,049,327; 3,160,384; 2,185,385; 2,677,523; and 3,704,851.

Some of the drawbacks inherent in the prior art devices are: complexity of manufacture leading to increased cost; sharp or multiple protrusions which can break when subjected to a heavy downward force or present surfaces which can snag or tear sheer material; oversimplified support mechanisms which are flimsy in construction and incapable of providing adequate support.

For a traverse or regular curtain rod, it is a simple matter to adjust the distance from the bottom of the supported material to the floor or floor covering by changing the length of the pins or hooks which support the material on the rod; however, for a decorator rod wherein the rod is inserted into a sleeve formed in the material, there is a need for a vertically and laterally adjustable support bracket. The problem has been recognized for a long time, but until now a satisfactory solution to the problem as embodied in the structure of the instant invention has not been found.

SUMMARY OF THE INVENTION

An object of the instant invention is to provide a smooth surfaced adjustable decorator rod support device which will reduce or eliminate the potential of material snags or tears when the rod is being inserted into the support or the height of the rod is being varied.

A further object of the invention is the provision of an adjustable decorator rod support device which is very easy to install and whose mounting bracket can be oriented right-side up or upside down with no variation in function.

Still another object of the invention is the provision of an adjustable support device which is both laterally or vertically adjustable.

Yet another object of the instant invention is the provision of an adjustable support device which utilizes a new and unique cooperation between the tangs on the support arm brace and the arrangement of receiving slots on the mounting bracket to insure that the decorator rod is rigidly supported in the vertical and lateral directions.

Another object of the instant invention is the provision of a three point contact support for the decorator rod when it is supported and secured within the support arm proper, to reduce the surface area of contact between the supporting and supported components.

These and other objects, advantages and novel features of the invention will become apparent from the following detailed description of the invention when considered in conjunction with the accompanying drawings.

DESCRIPTION OF THE PREFERRED EMBODIMENT

Figure 1:
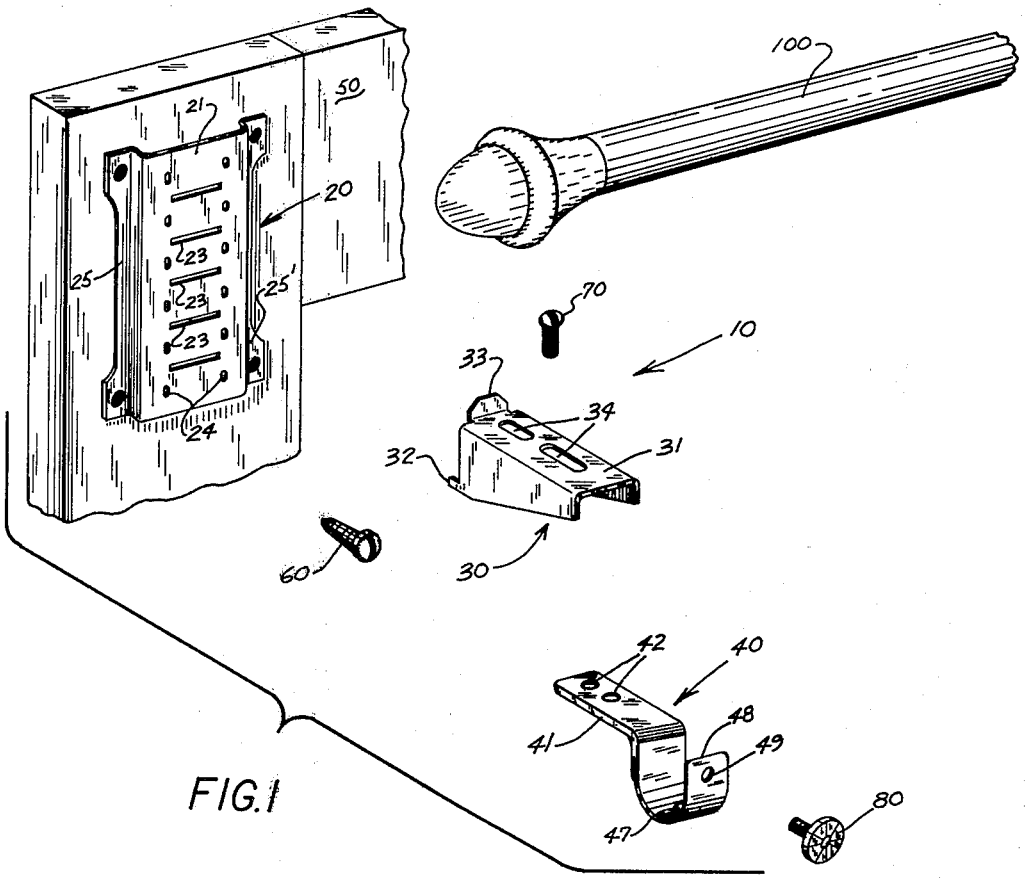
FIG. 1 is an exploded perspective view of the main structural elements which comprise the instant invention.

As can be seen by reference to FIG. 1, the adjustable decorator bracket of the instant invention is designated generally as 10, and comprises a mounting bracket 20, a removable support member 30, and an elongated adjustable support arm 40.

The mounting bracket 20 has a raised elongated u-shaped central portion 21 which extends across the major portion of its width and forms a channel 22 whose purpose and function will be explained further on. Arranged on the face of the central portion 21 are a plurality of horizontally disposed slots 23 and vertically disposed apertures 24. The slots 23 and apertures 24 are arranged so that the bracket 20 can be mounted right-side up or upside down and the slots and apertures will remain in the same relative position with respect to one another. The central portion 21 further terminates in flat, recessed and apertured sides 25 and 25[1]. The sides 25 and 25[1] have a recess 26 disposed along their respective lengths for aesthetic purposes, and mounting apertures 27 disposed proximate their ends, to secure the bracket 20 flush with a support surface 50 such as a window casement, frame or the like. The bracket 20 is fastened to the support surface 50 by suitable securing means 60 which extend through the mounting apertures 27 and penetrate the support surface 50.

The removable support member 30 comprises a tapered generally u-shaped channel member 31. The rearward end of the channel member 31 has a plurality of tabs 32 projecting outwardly therefrom, and a centrally disposed tang 33 projecting upwardly therefrom. The tabs 32 and tang 33 are dimensioned to be received within the vertical apertures 24 and horizontal slots 23, respectively to secure the support member 30 to the mounting bracket 20. The channel member 31 is further provided with elongated adjustment slots 34 in its top surface, which cooperate with suitable fastening means 70 to support and position the elongated support arm 40 at variable distances from the mounting bracket 20.

The support arm 40 comprises an elongated flat section 41 having a plurality of apertures 42 dimensioned to receive the fastening means 70. The free end of the support arm 40 terminates in a generally curved rod receiving portion 43. The rod receiving portion 43 has an inboard flat side section 45, and a generally flat bottom section 46 having a raised member 47 projecting upwardly therefrom, and a curved upwardly extending outboard section 48 having a locking aperture 49 disposed proximate its end. The locking aperture 49 is further dimensioned to receive a locking screw 80.

Figure 2:
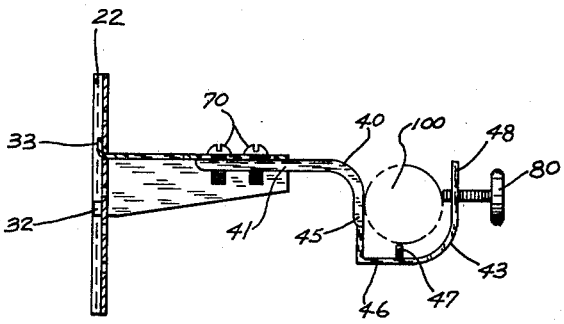
FIG. 2 is a side cross-sectional view of the bracket and support arm in their assembled relationship.

The operation of the adjustable decorator bracket 10 is as follows: the mounting bracket 20 is secured to the support surface 50 at a suitable location and the removable support member 30 is secured to the bracket 20 by insertion of the tang 33 into a given horizontal slot 23; the support member 30 is then pivoted downwardly about the tang 33 until the tabs 32 engage the vertical apertures 24. As can be seen in FIG. 2, the tabs 32 are dimensioned such that they extend the entire depth of the channel 22; the dimensions of the tabs 32 and tang 34 are such that they cooperate with the bracket 20 to virtually eliminate any lateral or torque induced downward translation of the support member 30 with respect to the bracket 20; the tang 33 bears against the interior of the channel 22 and the ends of the tabs 32 bear against the support surface 50 to absorb the downwardly directed torque forces; the length of the tabs 32 allows any lateral forces on the support member 30 to be transmitted to the bracket 20; due to the elongated adjustment slots 34, the elongated support arm 40 may be secured at a variety of lateral positions with respect to the mounting bracket 40; once the support arm has been secured to the support member, a decorator rod 100 supporting a fabric (not shown) may be placed in the rod receiving portion 43 of the support arm 40; due to the construction of the rod receiving portion 43, the rod 100 has only point contact with the inboard side 45 and raised portion 47 of the support arm; the remaining point of contact for the rod 100 is with the locking means 80; when the locking means 80 engages the rod 100, the point of contact is above the horizontal diameter of the rod; this effectively reduces the clearance between the contacting end of the locking means 80 and the inboard side 45 of the support arm 40 to less than the diameter of the rod thereby securing and supporting the rod within the adjustable bracket 10.

Figure 3:
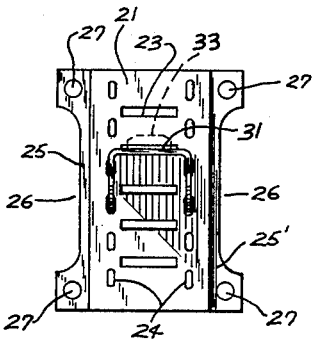
FIG. 3 is a front elevational view of the bracket and the main support arm brace in their assembled relationship.

A variation of the preferred embodiment (not shown) envisions an elongated version of the mounting bracket depicted in FIGS. 1–3 having additional horizontal slots and vertical apertures, having the same spacing and arrangement as depicted in the preferred embodiment, which will accommodate a plurality of support members 30 and arms 40 having different lateral spacing from the bracket 20.

Having thereby disclosed the subject matter of the invention, it should be obvious that many modifications, substitutions and variations of the invention are possible in light of the above teachings. It is, therefore, to be understood that the invention may be practiced other than as specifically described and should be limited only by the breadth and scope of the appended claims.

I claim:

1. An adjustable decorator rod support device comprising:

a mounting bracket including a first horizontally disposed slot therein, said mounting bracket having side portions having means thereon for attachment to a wall and a raised central portion forming a channel;

a second horizontally disposed slot in said raised central portion of said mounting bracket, said second slot being located above the first slot;

a first pair of apertures disposed in said raised central portion of said bracket, said first pair of apertures being located generally between and adjacent to each operative end of said first and second horizontally disposed slots;

a third horizontally disposed slot in said raised central portion of said mounting bracket located below the first slot;

a second pair of apertures disposed in said raised central portion of said bracket, said second pair of apertures being located generally between and adjacent to each operative end of said first and third horizontally disposed slots;

an elongated support arm;

means for connection to a decorator rod on one end of said elongated support arm, said elongated support arm comprising a flat central portion and a pair of downwardly depending side portions attached to said flat central portion; and engaging means including a first portion and a second portion on the other end of said support arm for engaging one of said horizonally disposed slots and one pair of said apertures by inserting the second portion into one of said slots, and then rotating said elongated support arm downwardly 90 degrees about an axis disposed at the point of connection between the first and second portions, whereby said elongated support arm is vertically adjustable with respect to said mounting bracket, said engaging means comprising a first portion extending from and lying in the same plane as said flat central portion of said elongated support arm and a second portion connected to and disposed at a right angle with respect to said first portion, said second portion having a width no wider than the width of said first portion and the width of said first and second portions being less than the width of said first, second and third slots, said first, second and third slots being of substantially the same shape as the cross-sectional shape of said first portion, and tab means attached to and extending from each of said downwardly depending side portions for snug reception in one of said pair of apertures for preventing said elongated support arm from pivoting downwardly or from side-to-side when said first portion of said engaging means is disposed in one of said slots and said tab means are disposed in one of said pair of apertures.

2. An adjustable decorator rod support device as in claim 1 wherein:

the rod connection means has a raised member disposed at its mid-point, and is further provided with a locking mean on its outboard end.

3. An adjustable decorator rod support device as in claim 2 wherein:

a decorator rod is supported by the raised member on the rod receiving portion.

4. An adjustable decorator rod support device as in claim 3 wherein:

each end of the decorator rod is subjected to only point contact with the rod receiving portion raised member and locking means in its supported relationship.

* * * * *